United States Patent [19]

Kawatei

[11] Patent Number: 4,509,491

[45] Date of Patent: Apr. 9, 1985

[54] OVERFLOW VALVE FOR DISTRIBUTOR-TYPE FUEL INJECTION PUMPS

[75] Inventor: Hisatsugu Kawatei, Higashimatsuyama, Japan

[73] Assignee: Diesel Kiki Co., Ltd., Tokyo, Japan

[21] Appl. No.: 547,949

[22] Filed: Nov. 2, 1983

[30] Foreign Application Priority Data

Nov. 9, 1982 [JP] Japan ..... 57-168651[U]

[51] Int. Cl.[3] ..... F02M 59/20

[52] U.S. Cl. ..... 123/502; 123/506

[58] Field of Search ..... 123/502, 506, 459, 449, 123/387, 382, 383

[56] References Cited

U.S. PATENT DOCUMENTS

| | | | |
|---|---|---|---|
| 4,273,090 | 6/1981 | Hofer et al. | 123/502 |
| 4,346,688 | 8/1982 | Kaibara et al. | 123/502 |
| 4,378,002 | 3/1983 | Konrath et al. | 123/502 |
| 4,387,683 | 6/1983 | Gheim | 123/502 |
| 4,409,942 | 10/1983 | Gheim | 123/502 |
| 4,437,444 | 3/1984 | Yasuhara | 123/459 |

FOREIGN PATENT DOCUMENTS 55-49078 9/1980 Japan .

*Primary Examiner*—Magdalen Y. C. Moy

*Attorney, Agent, or Firm*—Frishauf, Holtz, Goodman & Woodward

[57] ABSTRACT

An overflow valve is provided in a distributor-type fuel injection pump, for returning excess fuel from the suction chamber of the pump to a lower pressure zone in the pump. The valve comprises a passage communicating with the suction chamber, a check valve arranged within the passage and operable in response to the suction chamber pressure for closing and opening the same passage, and throttle forming means formed by the passage and the check valve. The valve body of the check valve has a pressure-applying surface on which the suction chamber pressure acts in the valve-opening direction, and which assumes a larger surface area when the valve is in an open position than when it is in a closed position. The check valve is closed at the start of the engine to increase the suction chamber pressure so that the timing device of the fuel injection pump acts to advance the fuel injection timing.

2 Claims, 5 Drawing Figures

OVERFLOW VALVE FOR DISTRIBUTOR-TYPE FUEL INJECTION PUMPS

BACKGROUND OF THE INVENTION

This invention relates to an overflow valve for use in a distributor-type fuel injection pump.

Internal combustion engines, particularly Diesel engines with divided combustion chambers have some difficulties in starting at low temperatures. As a starting aid, a glow plug has conventionally been used, which preheats the intake air. Besides such starting aid, the timing device of the fuel injection pump is adapted to advance the fuel injection timing at the start of the engine, to thereby improve the startability of the engine as well as reduce emission of hydrocarbons from the engine. A timing device provided in a distributor-type fuel injection pump is generally designed to be controlled by fuel pressure within the suction chamber of the fuel injection pump. However, according to such a timing device, at the start of the engine, the rotational speed of the engine is so low that the suction chamber pressure is not yet increased to a level sufficient for the timing device to obtain a required advance in the fuel injection timing. That is, the suction chamber is supplied with fuel pumped by a feed pump which is driven by the engine, and therefore the suction chamber pressure varies in proportion to the rotational speed of the engine so that the timing device responsive to the suction chamber pressure eventually operates in response to the rotational speed of the engine. Therefore, it is necessary to control the fuel injection timing for improvement of the startability of the engine so as to advance same independently of the rotational speed of the engine upon and immediately after the start of the engine.

To comply with such requirement, a timing device has been proposed by Japanese Provisional Utility Model Publication No. 55-49078, which is adapted to advance the fuel injection timing at the start of an internal combustion engine. According to this proposed timing device, an auxiliary piston is arranged on an extension of the axis of the timer piston of the timing device for urging contact therewith by the force of an auxiliary spring. One end of the auxiliary piston cooperates with an opposed end of the timer piston to define a pressure chamber supplied with fuel having pressure variable as a function of the rotational speed of the engine from the suction chamber of a fuel injection pump associated with the timing device. When the pressure of fuel supplied into the pressure chamber is low at the start of the engine, the auxiliary spring urgingly biases the timer piston in the injection timing-advancing direction, to thereby obtain an advance in the injection timing. Then, as the pressure within the suction chamber increases with an increase in the engine rotational speed, the auxiliary piston is moved by correspondingly increased pressure within the pressure chamber against the force of the auxiliary spring, accompanied by movement of the timer piston in the injection timing-retarding direction by the force of a timer spring urging same toward the auxiliary piston, to retard the fuel injection timing. After this, as the engine rotational speed further rises to cause a further corresponding increase in the suction chamber pressure, correspondingly increased pressure within the pressure chamber causes movement of the auxiliary piston to its most receded position while compressing the auxiliary spring, and thereafter a further increase in the engine rotational speed causes movement of the timer piston in the injection timing-advancing direction against the force of the timer spring, whereby injection timing control is effected in response to the varying engine rotational speed.

However, the above proposed timing device is inevitably large in size and complicated in structure due to the structural disadvantage that the timer piston is directly driven by the auxiliary piston arranged in line therewith to obtain an initial starting advance in the injection timing, requiring a large mounting space and a large manufacturing cost.

As another measure for obtaining an initial starting advance in the injection timing, if the setting pressure of a pressure-regulating valve for regulating the pressure of fuel supplied into the suction chamber is set at a larger value than a usual value, an advance can be obtained in the injection timing at the start of the engine. However, according to this another measure, the timing device is kept in the injection timing-advancing position even after the starting condition of the engine is over, and then the injection timing cannot be controlled to best values appropriate to the rotational speed of the engine.

SUMMARY OF THE INVENTION

It is an object of the invention to provide an overflow valve for use in a distributor-type fuel injection pump, which is adapted to cause a substantial increase in the suction chamber pressure at the start of the engine so as to improve the startability of the engine, etc., thereby making it unnecessary to use starting injection timing-advancing means mounted on the timing device.

It is a further object of the invention to provide an overflow valve provided with the above-mentioned starting injection timing-advancing function, for use in a distributor-type fuel injection pump, which is simple in structure and low in manufacturing cost.

It is another object of the invention to provide a distributor-type fuel injection pump which is equipped with an overlfow valve provided with the above-mentioned starting injection timing-advancing function.

According to the invention, there is provided an overflow valve for use in a distributor-type fuel injection pump for an internal combustion engine, having a suction chamber filled with fuel variable in pressure as a function of the rotational speed of the engine, and a timing device operable in response to the pressure of the fuel within the suction chamber for advancing the fuel injection timing of the fuel injection pump with an increase in the pressure of the fuel within the suction chamber. The overflow valve serves to return excess fuel from the suction chamber to a zone under lower pressure of the fuel injection pump, and comprises: a passage having one end communicating with the suction chamber and another end communicating with the above lower pressure zone; a check valve arranged within the above passage and responsive to the pressure of the fuel within the suction chamber for closing and opening the same passage; and means for forming a throttle in the above passage when the check valve is in an open position. The check valve has a valve body having a pressure-applying surface area on which the pressure of the fuel within the suction chamber acts in a direction of opening the check valve, and which assumes a first surface area when the check valve is in a closed position, and a second surface area larger than the first surface area when it is in an open position.

The above and other objects, features and advantages of the invention will be more apparent from the ensuing detailed description taken in conjunction with the accompanying drawings.

DETAILED DESCRIPTION

Details of the invention will now be described with reference to the drawings.

Figure 1:
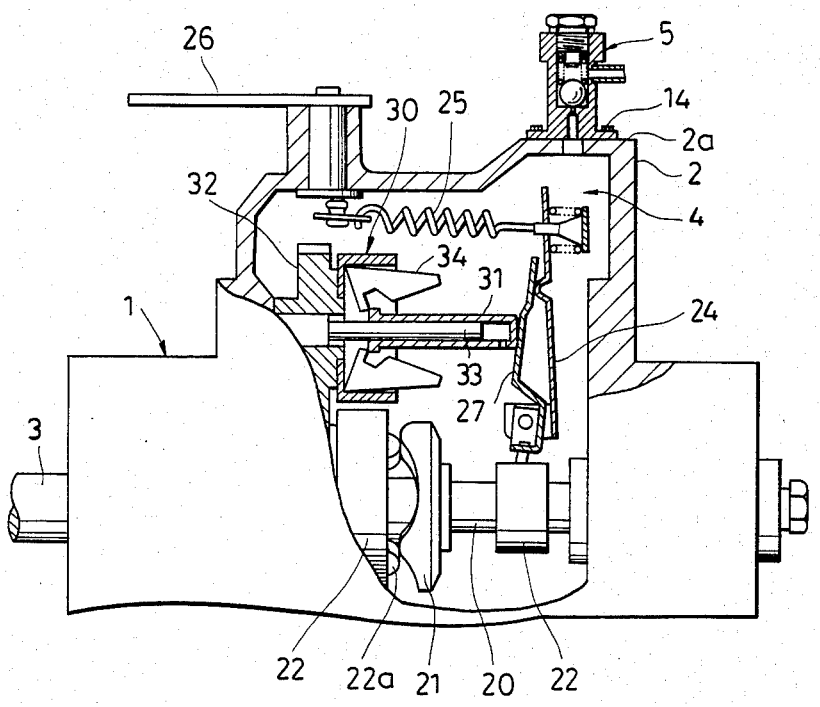
FIG. 1 is a sectional side view of a distributor-type fuel injection pump to which is applied an overflow valve according to an embodiment of the invention, with essential component parts shown in section.

Referring first to FIG. 1, there is illustrated a distributor-type fuel injection pump provided with an overflow valve according to an embodiment of the invention. The fuel injection pump 1 is provided with a supply pump, not shown, incorporated therein and disposed to be driven by a drive shaft 3 which is in turn driven by an engine, not shown, to rotate at speeds as a function of the rotational speed of the engine. The supply pump is operable to pump fuel out of a fuel tank, not shown, and supplies the pumped fuel into a suction chamber 4 defined within the housing 2 of the fuel injection pump 1. Therefore, the pressure within the suction chamber 4 is variable as a function of the rotational speed of the engine. An overflow valve 5, details of which will be described later, is mounted on a ceiling wall 2*a* of the housing 2, to return excessive part of the fuel within the suction chamber 4 to the fuel tank.

A plunger 20 has an end portion slidably received within a plunger barrel, not shown, mounted within the housing 2 and carries a cam plate 21 secured to the other end thereof. The cam plate 21 has a camming end face kept in urging contact with rollers 22*a* carried by a roller holder 22 slightly rotatably fitted on an end of the drive shaft 3, by the force of a plunger spring, not shown. The other end of the plunger 20 is coupled to the above end of the drive shaft 3 by means of a driving disc, not shown, interposed therebetween. Thus, the plunger 20 is rotatable about its own axis in unison with the drive shaft 3, with simultaneous axial reciprocating motions due to the rolling engagement of the rollers 22*a* with the cam plate 21, to thereby compress fuel introduced into a pump working chamber, not shown, from the suction chamber 4, at predetermined angular positions thereof, and successively deliver same to fuel injection valves, not shown, of the engine.

A regulating collar 22 is slidably fitted on the plunger 20, connected to a control lever 26 through a tensioning lever 24 and a governor spring 25, and engaged by an end face of a sliding sleeve 31 of a centrifugal governor 30 through a starting lever 27. The centrifugal governor 30 has a toothed gear 32 meshing with another toothed gear, not shown, rigidly fitted on the drive shaft 3 to be rotatatively driven thereby. The sliding sleeve 31 is axially slidably fitted on a governor shaft 33 supported by the toothed gear 32 and has an end face disposed in urging contact with the starting lever 27 and the other end face urgedly engaged by a pair of flyweights 34 which are mounted on the toothed gear 32 for rotation in unison therewith and are radially expandable in response to its own centrifugal force produced during their rotation. Thus, the sliding sleeve 31 is axially movable by the flyweights 34 radially displaced as a function of the rotational speed of the engine, to thereby control the position of the regulating collar 22 relative to the plunger 20 through the action of the starting lever 27. The regulating collar 22 is also controlled in position in response to the angular position of the control lever 26 through the actions of the governor spring 25 and the tensioning lever 24. Thus, the quantities of fuel supplied to the fuel injection valves are controlled.

Figure 2:
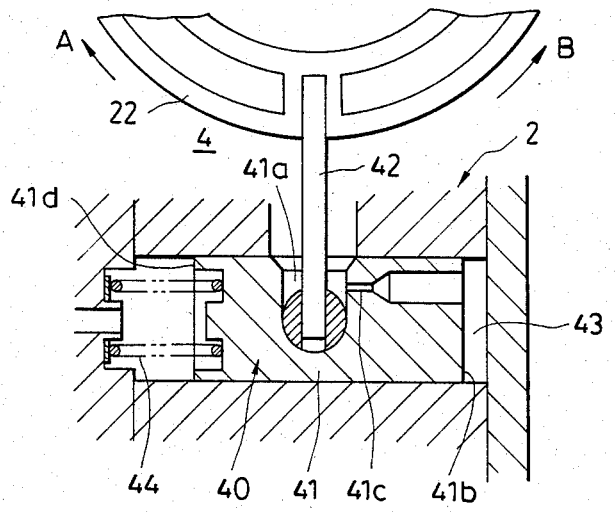
FIG. 2 is a sectional view of a timing device provided in the fuel injection pump of FIG. 1.

As shown in FIG. 2, a timing device 40 is arranged beneath the roller holder 22 in the housing 2. In the timing device 40, a timer piston 41 is coupled to a lower portion of the roller holder 22 by means of a coupling rod 42. The timer piston 41 is formed therein with a hole 41*a* in which the coupling rod 42 is pivotally engaged, as well as an orifice passage 41*c* communicating at one end with the hole 41*a* and terminating at the other end in an end face 41*b* of the timer piston 41. A pressure chamber 43 is defined between the above end face 41*b* of the piston and an opposed internal surface of the housing 2. Thus, pressurized fuel within the suction chamber 4 is introduced into the pressure chamber 43 through the hole 41*a* and the orifice passage 41*c*. A returning timer spring 44 is interposed tautly between the other end face 41*d* of the timer piston 41 and an opposed internal surface of the housing 2, and urges the timer piston 41 in the rightward direction as viewed in FIG. 2.

The timer piston 41 is moved leftward or rightward in FIG. 2 in response to the difference between the fuel pressure within the pressure chamber 43 transmitted from the suction chamber 4 through the orifice passage 41*c* and the urging force of the timer spring 44, to cause rotation of the roller holder 22 in an injection timing-advancing direction indicated by the arrow A in FIG. 2 or in the opposite injection timing-retarding direction indicated by the arrow B in the same figure. When the roller holder 22 is rotated in the direction of the arrow A, the timing of starting the fuel delivery by the plunger 20 to the fuel injection valves is advanced, whereas if the roller holder 22 is rotated in the direction of the arrow B, the same timing is retarted.

Figure 3:
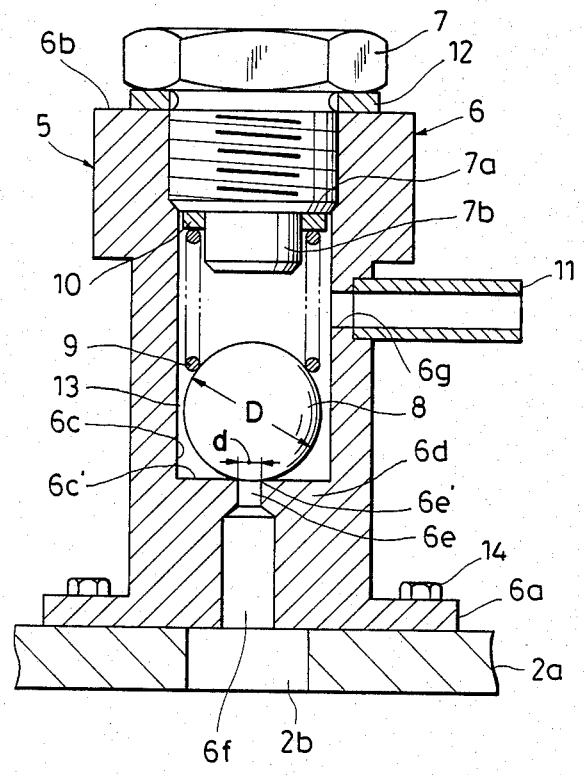
FIG. 3 is an enlarged longitudinal sectional view of the overflow valve in FIG. 1.

The overflow valve 5 is constructed as shown in FIG. 3. A holder 6 of the overflow valve 5 has a bottom portion 6*a* in the form of an annular flange, which is rigidly joined to the outer surface of the ceiling wall 2*a* of the housing 2 by means of fastening bolts 14. The holder 6 is formed along its axis with a valve bore 6*c* having a circular cross section and opening in an upper end face 6*b* of the holder 6 which is closed by a cap 7 threadedly fitted in the valve bore 6*c*. Movably arranged within the closed valve bore 6*c* is a ball 8 in a manner spaced from the inner peripheral surface of the valve bore 6*c* by a small clearance. A coil spring 9 is interposed between the ball 8 and a lower end face 7*a* of the cap 7 and urges the ball toward a bottom surface 6*c*′ of the valve bore 6*c*. The holder 6 has its lower portion 6*d* formed along its axis with a small bore 6*e* having a predetermined inner diameter much smaller than that of the valve bore 6*c* and disposed in concentricity with the valve bore 6c, as well as a hole 6f having a larger inner diameter, continuing from the small bore 6e in concentricity therewith and opening in a lower end face of the bottom portion 6a. The hole 6f is aligned with a through hole 21b formed through the ceiling wall 2a of the housing 2 and thus communicates with the suction chamber 4 within the housing 2 through the hole 21b. Formed in the peripheral wall portion of the holder 6 at a predetermined location is a through hole 6g as an overflow passage, in which is fitted an end of a connection pipe 11 leading to a lower pressure zone in the pump 1, for instance the fuel tank. The cap 7 has an extension 7b with a smaller diameter from the lower end face 7a, around which is fitted the coil spring 9.

The ball 8 is disposed within the valve bore 6c in such a manner that its outer surface defines an annular space 13 as a throttle passage in cooperation with the inner peripheral surface of the valve bore 6c. The outer diameter of the ball 8 is set at a value much larger than the inner diameter of the small bore 6e. The spring 9 has one end disposed in urging contact with the ball 8 and the other end with a shim 12 with a preselected thickness fitted on the extension 7b of the cap 7 in urging contact with the lower end face 7a of the cap 7, urging the ball 8 with a certain force against an opposed open end 6e' of the small bore 6e. In the illustrated state, the ball 8 is seated on the open end 6e' of the small bore 6e to close same. Thus, the ball 8 and the spring 9 cooperatively form a check valve. The outer diameter of the ball 8, the inner diameter of the open end 6e' of the small bore 6e, the clearance of the throttle passage 13 between the inner peripheral surface of the valve bore 6c and the outer surface of the ball 8, and the urging force or setting load of the spring 9 are set at such respective values as to obtain a suction chamber pressure characteristic required for achieving an optimum injection timing characteristic relative to the rotational speed of the engine. For instance, the inner diameter of the open end 6e' of the small bore 6e and the setting load of the spring 9 are set at such respective values that the check valve can be kept closed within a low engine speed range from 0–400 rpm.

With the above described arrangement, when the engine is at rest, the pressure P within the suction chamber 4 assumes a value of zero, wherein the ball 8 is positioned in urging contact with the bottom face 6c' of the valve bore 6c, closing the open end 6e' of the small bore 6e by the force of the spring 9. The setting pressure of the pressure regulating valve previously referred to, which is mounted within the housing 2 for regulating the pressure of fuel pumped into the suction chamber 4 by the supply pump, is set at a certain value larger than that of a pressure regulating valve used in a conventional distributor-type fuel injection pump without an overflow valve according to the present invention.

When the engine rotational speed is within a low speed range, e.g. 0–400 rpm at the start of the engine, the check valve is kept closed wherein the ball 8 is in the above-mentioned seated position closing the small bore 6e. On this occasion, there occurs no overflow of fuel from the suction chamber 4 so that the fuel pressure P within the suction chamber 4 abruptly increases at a large rate as the engine rotational speed Np increases, as indicated by the curved line Ia in FIG. 5. In the closed position of the check valve, the ball 8 has a pressure-applying surface area S1 represented by $\pi d^{2/4}$. The ball 8 is kept closing the small bore 6e by the spring 9 until the suction chamber pressure P exceeds a predetermined valve opening pressure Pa preset by the spring 9 and the shim 10.

Figure 4:
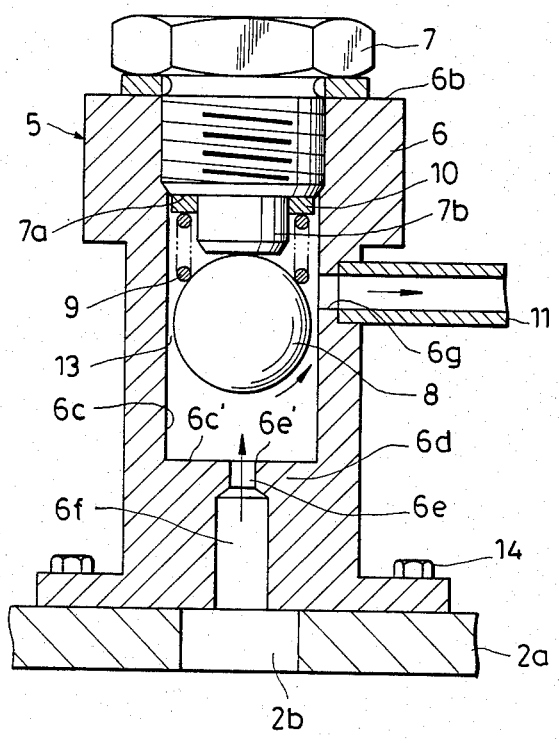
FIG. 4 is a view similar to FIG. 3, showing the same valve in a lifted position.

Thereafter, as the engine rotational speed further increases so that the suction chamber pressure P correspondingly increases to exceed the predetermined valve opening pressure Pa, the ball 8 is urgedly displaced by the increased suction chamber pressure P against the force of the spring 9, and can be even brought into contact with the tip of the extension 7b, as shown in FIG. 4. Then, the small bore 6e is opened to allow part of the pressurized fuel within the suction chamber 4 to be drained through the small holes 6f, 6e, the annular throttle passage 13, the hole 6g, and the interior of the connection pipe 11 into the fuel tank. As a result, the suction chamber pressure P drops along the curved line Ib by an amount ΔP in FIG. 5. On this occasion, the ball 8 has an increased pressure-applying surface area S2 represented by $\pi D^2/4$ (>S1). Due to the increased pressure-applying surface area, the ball 8 does not drop or drops through a very small stroke even if the suction chamber pressure P drops along the broken line in FIG. 5 so that the ball 8 will never close the small bore 6e so long as the engine continues its operation, thereby always allowing suitable overflow of fuel from the suction chamber. After the suction chamber pressure P has dropped along the curved line Ib in FIG. 5, the suction chamber pressure P increases with a further increase in the engine rotational speed along the straight line Ic in FIG. 5 in accordance with a predetermined suction chamber pressure characteristic adapted to the operating characteristics of an engine applied, during normal operation.

Since the overflow valve 5 according to the invention is thus adapted to make the overflow amount zero only at the start of the engine, while always allowing suitable overflow amounts when the engine is operating in other operating conditions, the suction chamber pressure can be elevated up to a required level so as to obtain a required advance in the fuel injection timing at the start of the engine, and can be controlled to proper values as a function of the rotational speed of the engine after the engine has shifted into normal operating conditions after the start thereof. Therefore, the engine can have improved startabilty, and during normal operation of the engine after the start, an optimum injection timing characteristic is available to thereby improve the output characteristics, emission characteristics, etc. of the engine.

Figure 5:
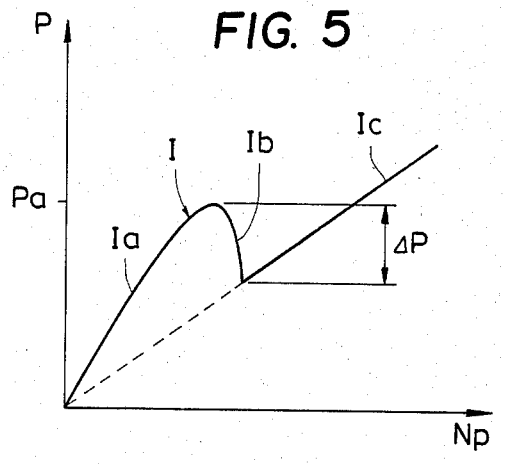
FIG. 5 is a graph showing the suction chamber pressure characteristic of the fuel injection pump of FIG. 1, plotted with respect to the rotational speed of the pump.

The sloping degree of the straight line Ic of the characteristic curved line I in FIG. 5 is determined by the cross-sectional area of the throttle passage 13 formed by the clearance between the inner peripheral surface of the valve bore 6c and the outer surface of the ball 8. Further, the drop amount ΔP of the suction chamber pressure in FIG. 5 upon opening of the check valve is a function of the overflow amount, that is, it increases as the overflow amount increases.

While a preferred embodiment of the invention has been described, variations thereto will occur to those skilled in the art within the scope of the present inventive concepts which are delineated by the following claims.

What is claimed is:

1. In a distributor-type fuel injection pump for an internal combustion engine, having a suction chamber filled with fuel, said fuel being variable in pressure as a function of the rotational speed of said engine, and a timing device operable in response to the pressure of said fuel within said suction chamber for advancing the fuel injection timing of said fuel injection pump with an increase in the pressure of said fuel within said suction chamber, an overflow valve for returning excess fuel from said suction chamber to a zone under lower pressure of said fuel injection pump, said overflow valve comprising:

a passage having one end communicating with said suction chamber and another end communicating with said lower pressure zone, said passage including:

a first bore having an inner peripheral surface and an inner diameter; and a second bore having one end opening in said first bore concentrically therewith and another end communicating with said suction chamber, said second bore having a diameter much smaller than that of said first bore;

a check valve arranged within said passage and responsive to the pressure of said fuel within said suction chamber for closing and opening said passage, said check valve having a valve body having a pressure-applying surface on which the pressure of said fuel within said suction chamber acts in a direction of opening said check valve, said pressure-applying surface assuming a first surface area when said check valve is in a closed position, and assuming a second surface area larger than said first surface area when said check valve is an open position, said check valve comprising:

a ball forming said valve body, said ball being movably received within said first bore of said passage and disposed to be liftably seated on said one end of said second bore of said passage for closing same, said ball having a diameter much larger than the diameter of said one end of said second bore; and a spring urging said ball toward said one end of said second bore;

said ball of said check valve having said pressure-applying surface, said pressure-applying surface assuming said first surface area when said ball is in a seated position closing said one end of said second bore, and assuming said second surface area when said ball is a lifted position opening said one end of said second bore;

said ball having an outer surface and having an outer diameter slightly smaller than the inner diameter of said first bore; and means for forming a throttle in said passage when said check valve is in said open position, said throttle forming means comprising said inner peripheral surface of said first bore and said outer surface of said ball, said throttle being formed by an annular space defined between said inner peripheral surface of said first bore and said outer surface of said ball when said ball is in said lifted position.

2. A distributor-type fuel injection pump for an internal combustion engine, comprising:

a suction chamber filled with fuel, said fuel being variable in pressure as a function of the rotational speed of said engine;

a timing device operable in response to the pressure of said fuel within said suction chamber for advancing the fuel injection timing of said fuel injection pump with an increase in the pressure of said fuel within said suction chamber; and an overflow valve for returning excess fuel from said suction chamber to a zone under lower pressure of said fuel injection pump, said overflow valve comprising:

a passage having one end communicating with said suction chamber and another end communicating with said lower pressure zone;

said passage including a first bore having an inner peripheral surface and an inner diameter, and a second bore having one end opening in said first bore concentrically therewith and another end communicating with said suction chamber, said second bore having a diameter much smaller than that of said first bore;

a check valve arranged with said passage and responsive to the pressure of said fuel within said suction chamber for closing and opening said passage, said check valve having a valve body having a pressure-applying surface on which the pressure of said fuel within said suction chamber acts in a direction of opening said check valve, said pressure-applying surface assuming a first surface area when said check valve is in a closed position, and assuming a second surface area larger than said first surface area when said check valve is in an open position;

said check valve comprising a ball forming said valve body, said ball being movably received with said first bore of said passage and disposed to be liftably seated on said one end of said second bore of said passage for closing same, said ball having a diameter much larger than the diameter of said one end of said second bore, and a spring urging said ball toward said one end of said second bore, said ball of said check valve having said pressure-applying surface, said pressure-applying surface assuming said first surface area when said ball is in a seated position closing said one end of said second bore, and assuming said second surface area when said ball is a lifted position opening said one end of said second bore;

said ball having an outer surface and having an outer diameter slightly smaller than the inner diameter of said first bore;

means for forming a throttle in said passage when said check valve is in said open position, said throttle forming means comprising said inner peripheral surface of said first bore and said outer surface of said ball, said throttle being formed by an annular space defined between said inner peripheral surface of said first bore and said outer surface of said ball when said ball is in said lifted position.

* * * * *